US007978805B1

(12) United States Patent
Blackburn

(10) Patent No.: US 7,978,805 B1
(45) Date of Patent: Jul. 12, 2011

(54) LIQUID GALLIUM COOLED HIGH POWER NEUTRON SOURCE TARGET

(75) Inventor: Brandon W. Blackburn, Winthrop, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/360,582

(22) Filed: Jul. 26, 1999

(51) Int. Cl.
*G21G 1/10* (2006.01)

(52) U.S. Cl. ..... 376/190; 376/194; 376/199

(58) Field of Classification Search ..... 376/190, 376/191, 192, 194, 195, 196, 197, 198, 199, 376/201, 202, 114; 315/502, 503, 504, 505; 313/62

See application file for complete search history.

(56) References Cited

U.S. PATENT DOCUMENTS

| | | | | |
|---|---|---|---|---|
| 3,267,730 | A * | 8/1966 | Satterthwaite et al. | 73/295 |
| 4,141,224 | A * | 2/1979 | Alger et al. | 62/50.1 |
| 4,811,687 | A * | 3/1989 | Prince | 118/666 |
| 4,953,191 | A * | 8/1990 | Smither et al. | 378/143 |
| 5,148,939 | A * | 9/1992 | Roser | 220/9.4 |
| 5,392,319 | A * | 2/1995 | Eggers | 376/194 |
| 5,784,423 | A * | 7/1998 | Lidsky et al. | 376/156 |
| 5,795,063 | A * | 8/1998 | Christiaens et al. | 374/43 |
| 5,917,874 | A * | 6/1999 | Schlyer et al. | 376/194 |
| 6,258,620 | B1 * | 7/2001 | Morel et al. | 438/57 |

FOREIGN PATENT DOCUMENTS

RU 2069 391 C1 * 11/1996

OTHER PUBLICATIONS

Pais et al, "Single-Phase Heat Trnasfer Characteristics of Submerged Jet Impingement Cooling Using JP-5", IEEE, in Inter-Society Conference on Thermal Phenomena 1994, pp. 178-183, IEEE catalog No. 0-7803-1372-0.*

American Heritage Dictionary of Idioms, 1997 "filled to the brim".*

Merriam-Webster's Collegiate Dictionary, tenth Edition, p. 328 (Merriam-Webster, Inc., Springfield, Massachusetts, USA (ISBN: 0-87779-708-0) (1999).*

Blackburn et al., "Development of a High-Power, Water-Cooled Beryllium Target for the Production of Neutrons in a High-Current Tandem Axccelerator", CP392, pp. 1293-1296, in 14th International Conference in "Applications of Accelerators in Research and Industry", Nov. 6-9, 1996, ed. J.L. Duggan and I.L. Morgan, AIP Press, New York © 1997.*

* cited by examiner

*Primary Examiner* — Johannes P Mondt
(74) *Attorney, Agent, or Firm* — Gauthier & Connors LLP

(57) ABSTRACT

A neutron source includes a low atomic number element target that is bombarded by incident energetic particles to provide a neutron flux. The source receives a controlled flow of liquid gallium that cools the target. The energetic particles may be for example protons or deuterons and the target is housed in a moderator/reflector assembly. Advantageously, the liquid gallium provides improved heat transfer, smaller flow rates and reduced stress on the target in comparison to prior art liquid coolants.

5 Claims, 2 Drawing Sheets

LIQUID GALLIUM COOLED HIGH POWER NEUTRON SOURCE TARGET

BACKGROUND OF THE INVENTION

The present invention relates to neutron sources, and in particular to high powered accelerator based neutron sources having liquid cooled targets.

Neutron capture therapies are two-part radiation therapies relying on the selective loading of tumor cells with a pharmaceutical containing $^{10}B$ (or other isotopes with high neutron capture cross-sections) and subsequent tissue irradiation with thermal neutrons. Boron is nonradioactive until a thermal neutron is captured causing a $^{10}B(n,a)^{7}Li$ fission reaction. The resulting alpha and lithium particles are high in energy (sharing 2.3 MeV), LET, and RBE, and travel less than 10 microns in tissue. These features lead to selective tumor-cell killing provided the $^{10}B$-containing pharmaceutical localizes well in the tumor. Other nuclides with high neutron capture cross-sections could also be used.

An external beam of thermal neutrons will be able to treat $^{10}B$-loaded tumors located at, or close to, the tissue surface. However, thermal neutrons are attenuated very rapidly in tissue. The need to provide a high flux of thermal neutrons at greater depths can be realized if a neutron beam with higher than thermal energy is used. The abundance of light hydrogen in tissue allows the higher energy ("epithermal") neutrons to be moderated through elastic collisions.

As the energy of the external neutron beam is increased, the thermal neutron flux at a given depth is increased. However, if the energy of the epithermal neutron beam is too high, the skin sparing due to 1/v reduction in the capture cross-section of $^{1}H$ and $^{14}N$ (and any $^{10}B$ located in healthy tissues near the surface) will be offset by an unacceptably large surface dose created by protons recoiling from collisions with fast neutrons. A trade-off must be realized, then, between maximizing the thermal neutron flux at depth, and minimizing the dose to healthy tissue (particularly at the surface). The question of which energy (or range of energies) results in the optimum trade-off for a particular neutron capture therapy application is important in the development of epithermal neutrons.

Sources of energetic neutrons include nuclear reactors and particle accelerators in which energetic charged particles bombard one or more of a variety of target materials. A number of reactions have been investigated as potential sources of epithermal neutrons including $^{7}Li(p,n)$ at energies between 1.88 and 3.5 MeV, and $^{9}Be(p,n)$ at energies between 1.8 and 4.1 MeV. These reactions are endothermic and require high power accelerators to generate sufficiently intense neutron beams. An alternate approach is to make use of the exothermic $^{9}Be(d,n)$ reaction. This reaction generates large quantities of high energy neutrons unless the deuteron bombarding energy is set below 2.0 MeV. It is then possible to design spectrum shifters (moderator/reflector assemblies) such that the final epithermal neutron beam from the $^{9}Be(d,n)$ reaction is suitable for clinical use in the treatment of deep-seated tumors (Boron Neutron Capture Therapy) or rheumatoid arthritis (Boron Neutron Capture Synovectomy). Details of neutron capture therapies are disclosed in co-pending U.S. application Ser. No. 08/919,870, entitled "Neutron Capture Therapies", which is hereby incorporated by reference.

In accelerator-based systems must be housed in a moderator/reflector assembly that is used to tailor the neutron energy to the specific treatment. The moderator/reflector assembly is typically cylindrical in cross section and contains liquid $D_2O$ moderator in a lead or graphite reflector. In order to limit the diameter of the final neutron beam targets are limited in size. Depending on charged beam particle size, power densities of 2-20 $MW/m^2$ may be encountered in targets having areas of 10-15 $cm^2$.

Conventional targets have been water cooled. For example, see U.S. Pat. No. 5,392,319. However, water cooled targets require high flow velocities and high flow rates in order to provide sufficient target cooling. An additional problem with water cooled targets is that high heat fluences at the target run the risk of exceeding the critical heat flux (CHF). Once the CHF is exceeded, the heat transfer significantly decreases and catastrophic system failure can follow.

Therefore, there is a need for an improved cooling system for neutron source particle targets.

SUMMARY OF THE INVENTION

Briefly, according to the present invention, a neutron source includes a low atomic number element target that is bombarded by incident energetic particles to provide a neutron flux. The source receives a controlled flow of liquid gallium that cools the target.

The energetic particles may be for example protons or deuterons and the target is housed in a moderator/reflector assembly.

Advantageously, the liquid gallium provides improved heat transfer, smaller flow rates and reduced stress on the target in comparison to prior art liquid coolants.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
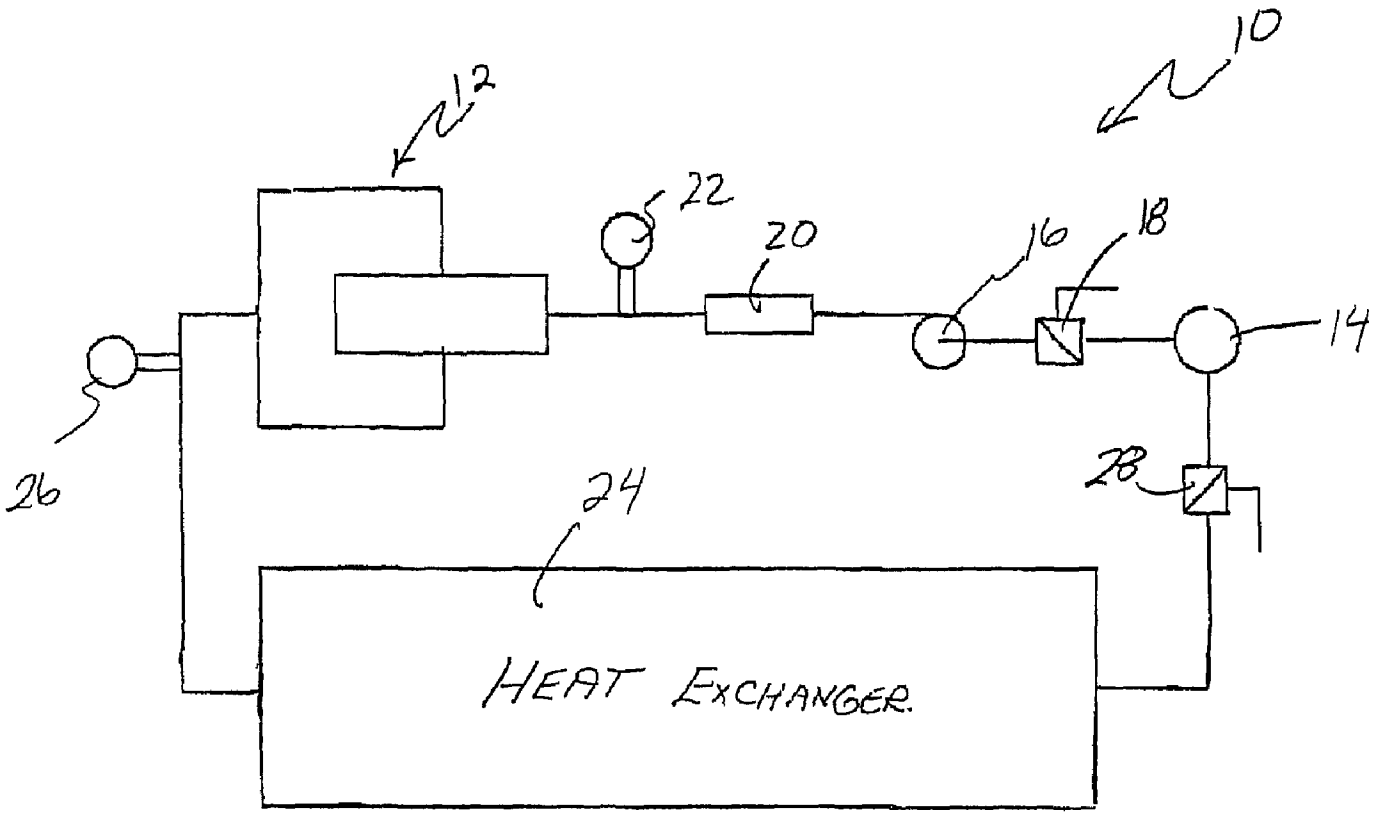
FIG. 1 is a functional block diagram illustration of a liquid gallium cooled high power neutron source.

FIG. 1 is a functional block diagram illustration of a liquid gallium cooled high power neutron source system 10. The system 10 comprises an accelerator based neutron source 12 that includes a low Z target (not shown). As known, the target emits neutrons in response to being bombarded by energetic particles, which may be for example protons or deuterons.

The system 10 includes a liquid gallium reservoir 14 that it connected to a pump 16 through a check valve 18. The system may also include a flow meter 20 and a pressure sensor 22 to monitor the flow of liquid gallium into the accelerator based neutron source 12 which is used to remove heat from the target. The liquid gallium flows from the accelerator based neutron source 12 through a heat exchanger 24 and back to the reservoir 14. A second pressure sensor 26 is also used for monitoring by a controller (not shown). A check valve 28 is disposed in the flow line between the reservoir 14 and the heat exchanger 24. The pump 16 provides a controlled flow of liquid gallium to cool the target (not shown) within the accelerator based neutron source 12.

Figure 2:
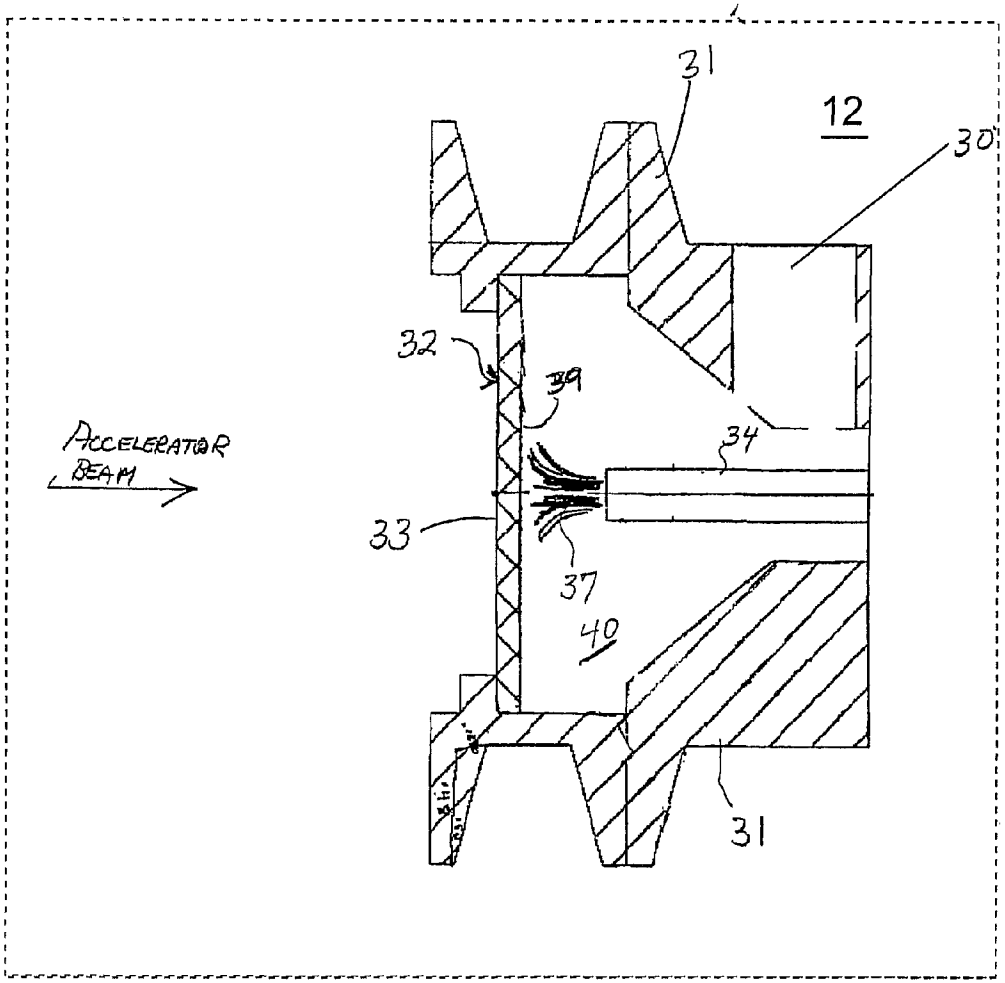
FIG. 2 is a cross sectional illustration of a portion of the accelerator based neutron source.

FIG. 2 is a cross sectional illustration of a portion of the accelerator based neutron source 12 (FIG. 1). The source 12 (FIG. 1) includes a stainless steel housing 31 within which is a beryllium target 32 having a first surface 33 that is bombarded by energetic particles, which may be for example protons or deuterons. In response, the beryllium target 32 produces a neutron flux that flows out of the source 12 through outlet 30, and in the process, the beryllium target 32 becomes very hot. According to the present invention, liquid gallium is used to cool the target 32.

The source 12 (FIG. 1) includes a nozzle 34 that receives the liquid gallium and provides a concentrated flow 37 of liquid gallium onto a second surface 39 of the target 32. The second surface 39 is on the opposite side of the first surface 33. The liquid gallium fills chamber 40 and exits to the heat exchanger 24 (FIG. 1).

Significantly, employing liquid gallium as the working fluid in a heat removal system for the neutron producing beryllium target allows the system to operate under conditions that would be beyond the critical heat flux of water with similar flow rates. Liquid gallium possesses thermo-physical properties that make it ideal for applications with heat fluences as high as 20 $MW/m^2$. Initial tests using water coolant illustrated that heat fluences of 15 $MW/m^2$ could be removed from a 0.254 cm thick beryllium target with high velocities in a submerged jet impingement configuration. These tests found that heat removal was due to forced convective boiling and required jet velocities of 24 m/s and flow rates of 87 GPM which were provided by a 15 hp centrifugal pump. Because the target relied on boiling for the heat transfer, critical heat flux (CHF) was a major concern at high heat fluences. During tests with water, in fact, CHF failure of the target was witnessed. As an alternative to using water at large flow rates and velocities, a working fluid was sought which could be used at similar heat fluences at a greatly reduced flow rate.

Liquid gallium can be pumped near room temperature and because of its low kinematic viscosity, Reynold's numbers (Re) are generated which are over a factor of two higher than those of water at similar flow velocities. Because it is a liquid metal, gallium possesses a thermal conduction coefficient which is over fifty (50) times higher than water.

Experiments to illustrate the effectiveness of gallium cooling were conducted using a 4.1 MeV tandem accelerator to heat a 0.254 cm thick beryllium target that was cooled with water or liquid gallium. Temperatures were measured at various target locations and at power loadings of 0-500 Watts with coolant flow rates of 1 L/min and coolant temperatures of 50° C. Because it was difficult to determine the size of the beam striking the target, several separate tests were run using first water and then gallium as the cooling fluid. Temperature measurements versus power loadings were made at similar optical settings to ensure beam sizes and associated heat fluences were similar. Temperature measurements were then used with the numeric code Adina to estimate the average heat transfer coefficient and beam size. Results of the temperature measurements indicate that for equal flow rates, gallium lowers the temperature interface between the fluid and the target by as much as 30%. At a flow rate of 1 L/min gallium was able to remove 490 Watts with an interface temperature increase of 25° C. compared to a 40° C. increase with water. Even at low flow rates gallium generates a convective heat coefficient of up to $6.0e^4$ $W/m^2K$. Unlike water which boils at 100° C., heat transfer from gallium would be linear up to the melting point of the target at 1200° C. CHF begins to be a problem with water cooling when the target surface temperature is higher than the saturation temperature by about 30° C. This is not the case with gallium, however, since it has a low vapor pressure and does not boil below 2200° C.

Significantly, gallium removes large heat fluences with low flow rates without the danger of exceeding the CHF. Because it is a liquid near room temperature, it does not require excessive heating or insulation. Unlike other liquid metal coolants like sodium or lithium it is not reactive with moisture, and it presents no toxicity concerns like mercury or lead bismuth eutectics.

Although the present invention has been discussed in the context of a beryllium target, one of ordinary skill will recognize that the present invention is certainly not limited to beryllium targets. It is contemplated that any neutron producing target (e.g., lithium) will enjoy the improved performance of the liquid gallium coolant. In addition, it is contemplated that the present invention has a broad application to accelerators and even lasers.

Although the present invention has been shown and described with respect to several preferred embodiments thereof, various changes, omissions and additions to the form and detail thereof, may be made therein, without departing from the spirit and scope of the invention.

What is claimed is:

1. A method of cooling a low Z target material of a neutron source assembly, comprising:

providing, by using a nozzle, a submerged jet of concentrated liquid gallium in a direction normal to a non-bombarded surface of the low Z target material within the neutron source assembly to cool the low Z target material;

providing a reservoir of liquid gallium; and pumping the liquid gallium, serially, from the reservoir, through the nozzle, such that the liquid gallium impinges upon the low Z target material in the neutron source assembly and cools the target material, from the neutron source assembly directly to a heat exchanger to remove heat from the liquid gallium, and from the heat exchanger to the reservoir.

2. The method of claim 1, wherein the target material comprises beryllium.

3. A neutron source assembly having a liquid cooled target, comprising:

an accelerator based neutron source including a low Z target material that is bombarded by accelerated particles to produce a neutron flux; and a cooling system to circulate liquid gallium through said accelerator based neutron source to cool the low Z target material;

said cooling system including a nozzle, said nozzle providing a submerged jet of concentrated liquid gallium in a direction normal to a non-bombarded surface of the low Z target material within the accelerator based neutron source;

said cooling system further including, a reservoir of liquid gallium;

a heat exchanger, and means for serially circulating said liquid gallium from said reservoir through said nozzle to impinge upon said surface of the low Z target material within said accelerator based neutron source, from said accelerator based neutron source directly to said heat exchanger, and from said heat exchanger to said reservoir.

4. The neutron source assembly of claim 3, wherein said means for circulating comprises a pump.

5. A liquid cooling system for a neutron source assembly, said cooling system comprising:

a reservoir of liquid gallium;

a heat exchanger;

a nozzle, said nozzle providing a submerged jet of concentrated liquid gallium in a direction normal to a non-bombarded surface of a low Z target material within the neutron source assembly; and means for serially circulating said liquid gallium from said reservoir through said nozzle to impinge upon said surface of the low Z target material within the neutron source assembly, from the neutron source assembly directly to said heat exchanger, and from said heat exchanger to said reservoir.

* * * * *

UNITED STATES PATENT AND TRADEMARK OFFICE

CERTIFICATE OF CORRECTION

PATENT NO. : 7,978,805 B1
APPLICATION NO. : 09/360582
DATED : July 12, 2011
INVENTOR(S) : Brandon W. Blackburn It is certified that error appears in the above-identified patent and that said Letters Patent is hereby corrected as shown below:

Please insert the following at column 1, line 3:

-- SPONSORSHIP INFORMATION
This invention was made with government support under Grant No. DE-FG02-89ER60874 awarded by the Department of Energy. The government has certain rights in this invention. --

Signed and Sealed this
Twentieth Day of December, 2011

David J. Kappos

David J. Kappos
*Director of the United States Patent and Trademark Office*